US005673445A

United States Patent [19]

Suter

[11] Patent Number: 5,673,445

[45] Date of Patent: Oct. 7, 1997

[54] BED FRAME

[76] Inventor: John S. Suter, 539 Haynes, Memphis, Tenn. 38111

[21] Appl. No.: 334,555

[22] Filed: Nov. 7, 1994

[51] Int. Cl.[6] ..... A47C 19/00

[52] U.S. Cl. ..... 5/400; 5/104; 5/108; 5/900.5

[58] Field of Search ..... 5/101, 104, 105, 5/106, 107, 108, 93.1, 655.1, 400, 412, 411, 900.5; 280/840, 718, 688, 702, 709, 711, 724

[56] References Cited

U.S. PATENT DOCUMENTS

| | | | |
|---|---|---|---|
| Re. 26,411 | 6/1968 | Alsobrook | 5/660 |
| 549,820 | 11/1895 | Pursell | 5/104 |
| 993,828 | 5/1911 | Westerheide | 5/81.1 |
| 1,069,196 | 8/1913 | Smith | 5/107 |
| 2,237,056 | 4/1941 | Manning | 280/718 |
| 2,765,478 | 10/1956 | Pinto | 5/104 |
| 3,540,756 | 11/1970 | Stout | 280/718 |
| 3,693,963 | 9/1972 | Leighton | 280/718 |
| 4,103,932 | 8/1978 | Parker . | |
| 4,195,853 | 4/1980 | Richardson | 280/718 |
| 4,225,152 | 9/1980 | Eaton | 280/718 |
| 4,344,643 | 8/1982 | Ray | 280/724 |
| 4,632,627 | 12/1986 | Swallows | 414/490 |
| 4,868,939 | 9/1989 | Tagtow | 5/118 |
| 5,205,005 | 4/1993 | Merrill et al. | 5/660 |

*Primary Examiner*—Steven N. Meyers
*Assistant Examiner*—Fredrick Conley

[57] ABSTRACT

An improved bed frame including a rectangular frame supported in a substantially horizontal disposition by a plurality of leaf springs connected thereto and by a axle rotably connected to the leaf springs and supported by two inflatable and elastic envelopes mounted at each end of the axle. A plurality of coil springs are attached to the rectangular frame laterally of the axle to provide additional elastic support of the rectangular frame at the periphery thereof. A plurality of rigid stop members are connected to the rectangular frame laterally of the axle to limit the downward movement of the rectangular frame. An inclined platform is connected to the rectangular frame for supporting a mattress and box spring ensemble.

12 Claims, 3 Drawing Sheets

BED FRAME

FIELD OF THE INVENTION

The present invention relates to bed frames for supporting a mattress and box spring ensemble. In greater particularity the present invention relates to elastic bed frames capable of vertical motion. In even greater particularity, the present invention relates to elastic bed frames capable of pivotal movement about a horizontal axis.

BACKGROUND OF THE INVENTION

Mattresses or box springs that provide elastic support of the human body are common in the bedding industry. Common mattresses and box springs are designed to flex slightly in response to the concentrated forces exerted thereon by particular parts of the human anatomy. Such elasticity is generally focused to the area of the mattress and box spring directly beneath the human body. The mattress and box springs are usually supported on a stationary, rigid bed frame and; accordingly, provide a padded but relatively static support of the human user.

The exception to the rigid bed frame, mattress and box springs assembly is the use of water beds whereby the mattress is composed of a hermetic envelope filled with water. A waterbed mattress not only flexes to accommodate the weight of specific concentrated pressure point of the human anatomy but also flexes as a unit to create a floating sensation. Unfortunately, waterbeds are difficult to move, tend to leak and are easily punctured, thus making the waterbeds unattractive and inconvenient to many users.

SUMMARY OF THE INVENTION

The principal objective of the invention is to provide a bed frame for elastically supporting a common mattress and box spring ensemble to provide a floating sensation to a person resting thereon.

In support of the principle object, another object of the present invention is to provide a pivotal platform for supporting a common mattress and box spring ensemble, that is elastically supported by a plurality of resistive springs.

These and other objects and advantages of the present invention are accomplished through the use of a rectangular frame supported by a plurality of leaf springs pivotally mounted to an axle assembly. The axle assembly is supported by two circular hubs each attached to an opposite end of the axle assembly and having an inflatable envelope engaged about the circumference of each hub. A plurality of coil springs are connected to the rectangular frame laterally of the axle assembly and extend downwardly from the rectangular frame to provide elastic resistance to a downward movement thereof. A plurality of rigid stop members are connected to the rectangular frame and extend a predetermined distance downwardly therefrom to limit the downward motion of the rectangular frame. An inclined platform is connected to the rectangular frame for supporting a mattress and box spring ensemble in an inclined position.

BRIEF DESCRIPTION OF THE DRAWINGS

Apparatus embodying features of my invention are depicted in the accompanying drawings which form a portion of this disclosure and wherein.

DESCRIPTION OF A PREFERRED EMBODIMENT

Figure 1:
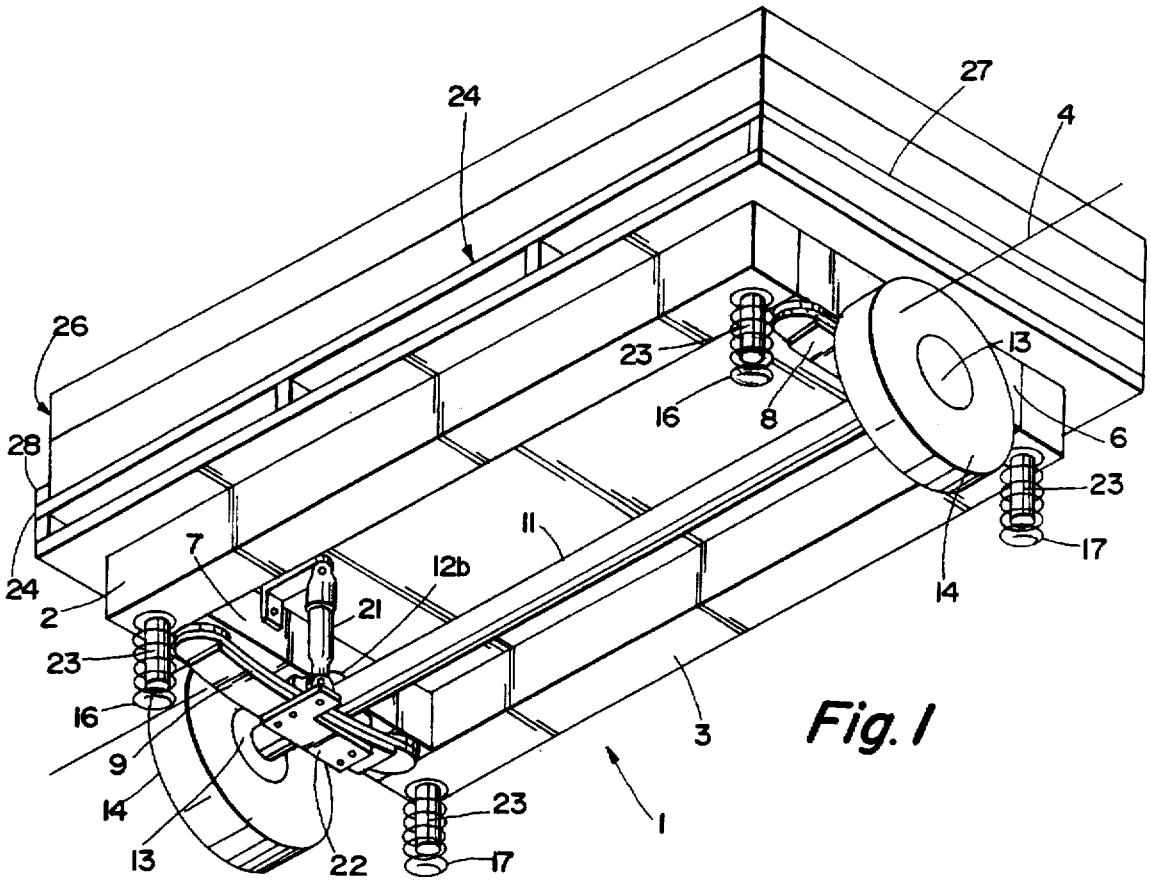
FIG. 1 is a perspective view of a preferred embodiment of the present invention.
Figure 2:
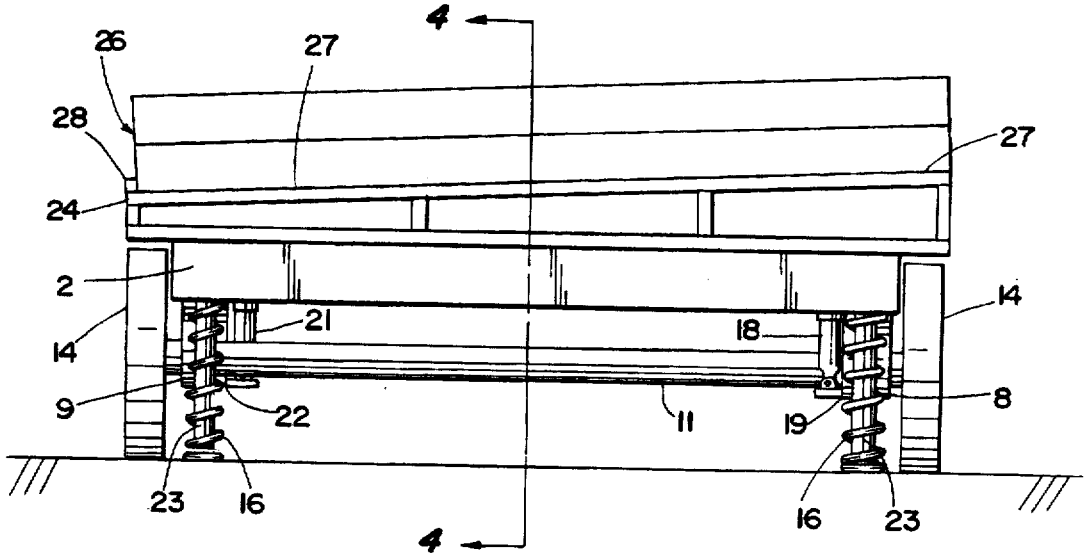
FIG. 2 is an elevational view of the preferred embodiment of the present invention.
Figure 3:
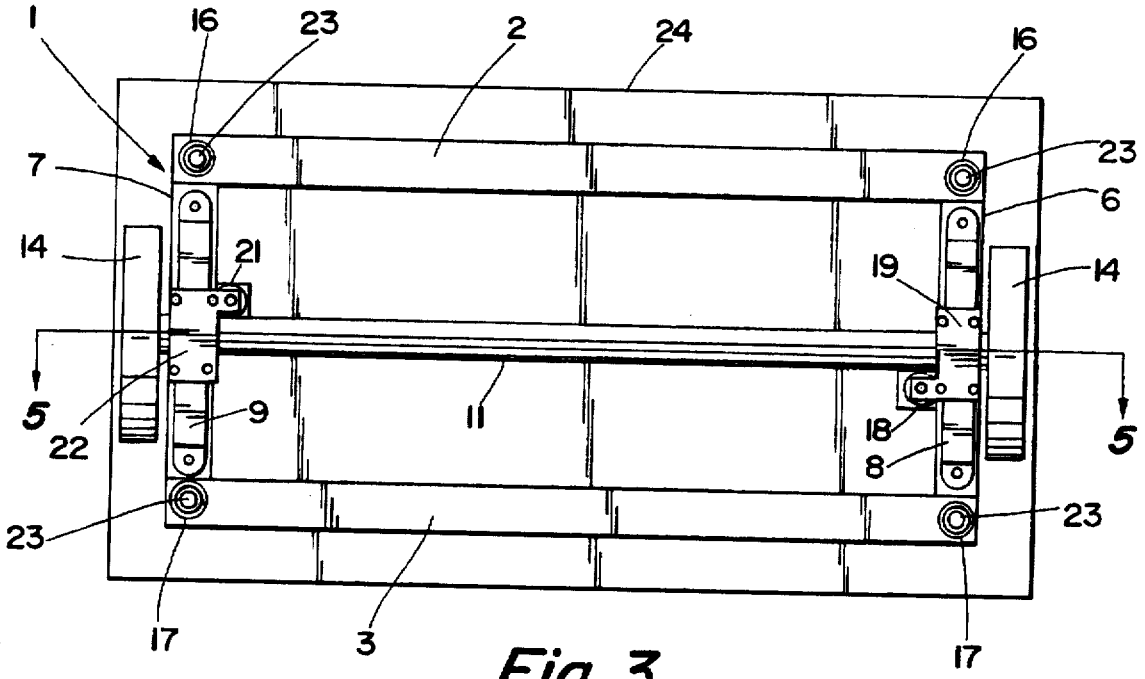
FIG. 3 is a bottom view of the preferred embodiment of the present invention.
Figure 4:
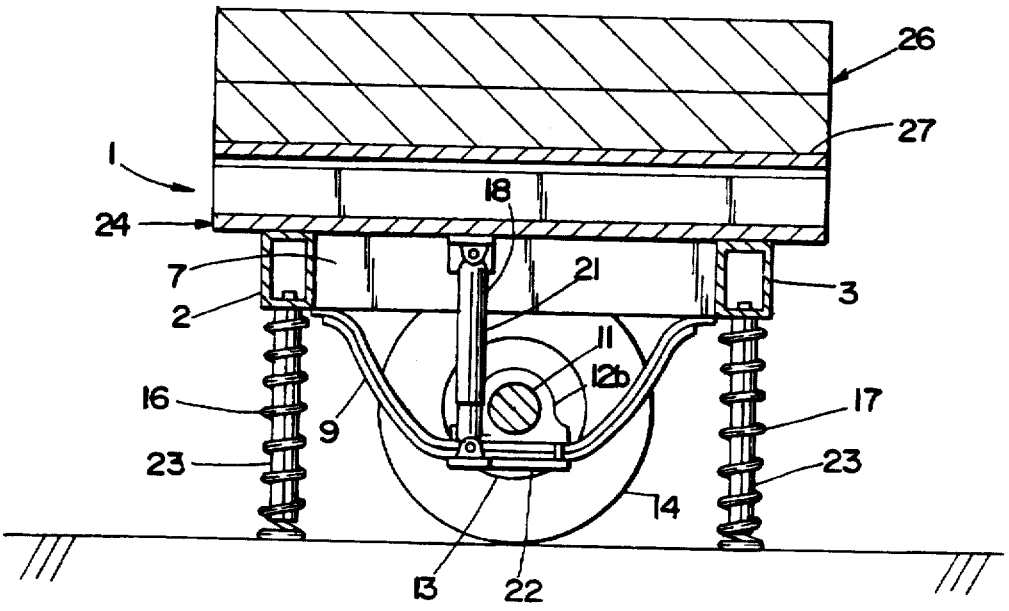
FIG. 4 is a sectional view of the preferred embodiment of the present invention taken taken along Line 4—4 of FIG. 2;.
Figure 5:
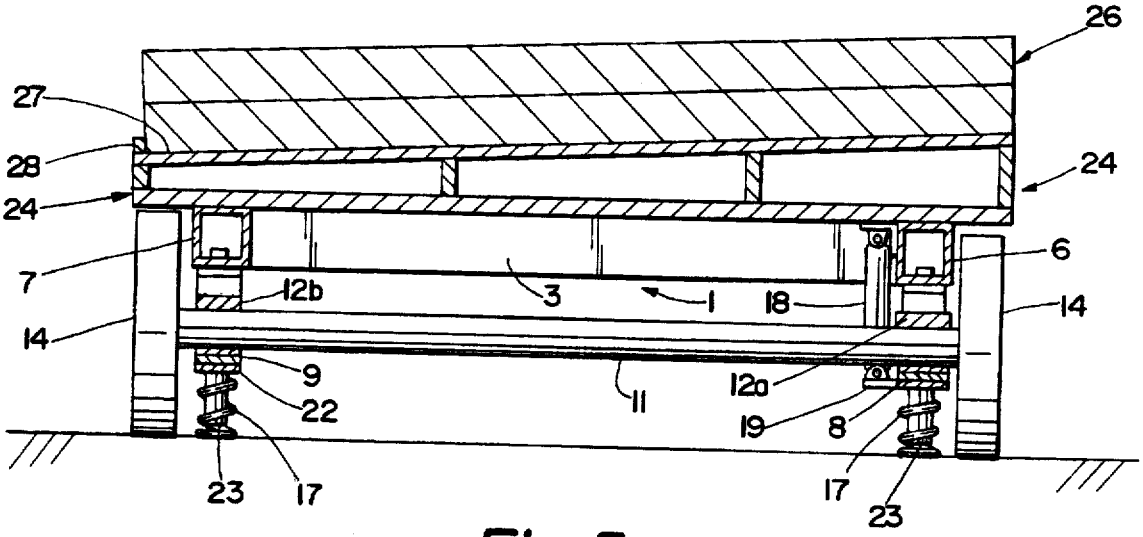
FIG. 5 is a sectional view of the preferred embodiment of the present invention taken along Line 5—5 of FIG. 3.
Figure 6:
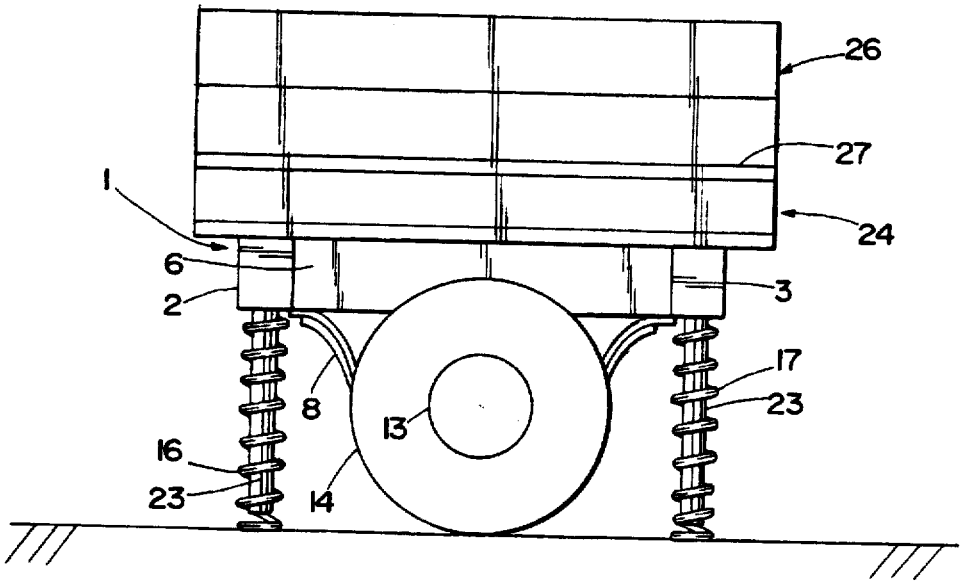
FIG. 6 is an end view of the preferred embodiment of the present invention.

Referring to the drawings for a clearer understanding of the invention, it should be noted in FIG. 1 that the present invention contemplates the use of a rectangular frame 1 having a left frame member 2 and a right frame member 3 extending parallel to a longitudinal axis 4. A first end member 6 and a second end member 7 are connected to the left and right frame members 2 and 3 at opposite ends thereof and in perpendicular relation thereto.

A first laminated plurality of leaf springs 8 are connected, at one end, to the first end member 6 proximate the left frame member 2 and at an opposite end, to the first end member 6 proximate to the right frame member 3. The first laminated plurality of flexible leaf springs 8 extend downwardly from the first end member 6 and are tensioned in a shallow U-shape. A second laminated plurality of flexible leaf springs 9 are connected, at one end, to the second end member 7 proximate the left frame member 2 and, at an opposite end, to the second end member 7 proximate the right frame member 3. The second laminated plurality of leaf springs 9 extend downwardly from the second end member 7 and are tensioned in a shallow U-shape.

An axle 11 is rotably mounted to the first and second laminated plurality of leaf springs 8 and 9 at a lowermost extension thereof by axle bearing mounts **12*a* and 12*b*. A pair of circumferential hubs 13 are connected to opposite ends of the axle 11 for engaging a pair of inflatable envelopes 14, extending about the circumference of the hubs 13. The inflatable envelopes 14 support the hubs 13 upon a support surface (not shown) such as a floor and, in turn, the axle 11, leaf springs 8 and 9, and the rectangular frame 1**.

A plurality of left coil springs 16 are connected to the left frame member 2 and extend downwardly therefrom and in contact with the support surface (not shown) to elastically support the left frame member 2 thereby limiting the movement of the left frame member 2 about the axle 11. A plurality of right coil springs 17 are connected to the right frame member 3 and extend downwardly therefrom in contact with the support surface (not shown) to elastically support the right frame member 3 thereby limiting the movement of the right frame member 3 about the axle 11.

A first pneumatic shock absorber 18 is connected to the first end member 6 and is mounted to the first laminated plurality of leaf springs 8 by a first shock absorber mount 19 connected to the first laminated plurality of leaf springs 8 adjacent to the axle bearing mount **12*a*. The first pneumatic shock absorber 18 provides elastic support of the first end member 6 relative to the axle 11. A second pneumatic shock absorber 21 is connected to the second end member 7 and is mounted to the second plurality of leaf springs 9 by a second shock absorber mount 22 connected to the second laminated plurality of leaf springs 9 adjacent to the axle bearing mount 12*b*. The second pneumatic shock absorber 21 provides elastic support of the second end member 7 relative to the axle 11. A plurality of rigid stop members 23 are connected to the left and right frame members 2 and 3 and extend downwardly therefrom to limit the downward movement of the left and right frame members when a downward force is exerted on the rectangular frame 1**.

An inclined platform 24 is connected to the rectangular frame 1 for supporting a mattress and box spring ensemble 26. The inclined platform 24 defines an upper planar support surface 27 on which the mattress and box spring ensemble 26 rests. The upper support surface 27 slopes downwardly from the first end member 6 toward the second end member 7 and has a retaining strip 28 affixed thereto perpendicular to the slope thereof for preventing slippage of the mattress and box spring ensemble 26.

In operation a user of the present invention who rests upon the mattress and box spring ensemble 26 will experience a floating sensation facilitated by the slight pivotal movement of the mattress and spring ensemble 26, inclined platform 24 and rectangular frame 1 about the axle 11. Such pivotal movement will be facilitated by movement of the user's body during the normal process of sleeping. As user's body moves laterally relative to the axle 11, the user's weight is distributed to and from either side of the rectangular frame 1 and, accordingly, facilitates the previously described pivotal movement. The coil springs 16 and 17 ensure that such pivotal movement is restricted such that the rectangular frame 1 and mattress and box spring ensemble do not tilt dramatically.

The elastic nature of the leaf springs 8 and 9 accommodate slight pivotal movement of the rectangular frame 1 and mattress and box spring ensemble 26 about an infinite number of axes not parallel to the axle 1. The complete sensation experienced by a human user resting on the mattress and box spring ensemble 26 supported by the present invention is that the mattress and box spring ensemble 26 is floating, as there is no rigid support or predetermined direction of motion. The motion previously described is, however, limited by the resistance exerted by the leaf springs 8 and 9, coil springs 16 and 17 and shock absorbers 18 and 21, such that the human user does not experience such a wide range of motion as would make the mattress and box spring ensemble 26 seem precarious. Further, movement of the rectangular frame 1 and, accordingly, the mattress and box spring ensemble 26, is completely limited by the downward extension of stop members 23, thus providing additional security to the human user that the mattress and box spring ensemble 26 will be supported in a relatively horizontal position.

While I have shown my invention in one form, it will be obvious to those skilled in the art that it is not so limited but is susceptible to various changes and modifications without departing from the spirit thereof.

What I claim is:

1. An improved bed frame resting on a horizontal, substantially planer support surface and comprising:

(a) a rectangular frame having a left frame member and a right frame member extending parallel to a longitudinal axis, a first end member and a second end member each connected to said left and right frame members at opposite ends thereof and in perpendicular relation thereto;

(b) an axle rotatably mounted to said rectangular frame and extending parallel to the longitudinal axis thereof;

(c) a pair of circular hubs connected to opposite ends of said axle;

(d) a pair of inflatable envelopes, each engaged by and extending around the diameter of one of said pairs of hubs wherein said envelopes are pneumatically inflated to support said pairs of hubs on said support surface;

(e) at least one left coil spring connected at one end thereof to said left frame member and extending downwardly from and in contact with said support surface to limit the rotation of said rectangular frame about said axle thereby elastically supporting said left frame member relative to said support surface; and (f) at least one right coil spring connected at one end thereof to said right frame member and extending downwardly therefrom and in contact with said support surface to limit the rotation of said rectangular frame about said axle thereby elastically supporting said right frame member relative to said support surface.

2. An improved bed frame as described in claim 1 further comprising:

(a) a first plurality of flexible leaf springs connected, at one end, to said first end member proximal to said left frame member and, at an opposite end, to said first end member proximal to said right frame member, wherein said first plurality of leaf springs extend downwardly from said first end member, and are tensioned in a shallow U-shape; and (b) a second plurality of flexible leaf springs connected, at one end, to said second end member proximal to said left frame member and, at an opposite end, to said second end member proximal to said right frame member, wherein said second plurality of leaf springs extend downwardly from said second end member and are tensioned in a shallow U-shape and wherein said axle is rotably mounted to said first and second plurality of leaf springs proximal a lowermost extension thereof.

3. An improved bed frame as described in claim 2 further comprising:

(a) a first pneumatic shock absorber connected to said first end member and mounted to said first plurality of leaf springs adjacent to said axle; and (b) a second pneumatic shock absorber connected to said second end member and to said second plurality of leaf springs adjacent to said axle, wherein said first and second pneumatic shock provide partial elastical support of said rectangular frame relative to said axles.

4. An improved bed frame as described in claim 2 further comprising one or more rigid stop members connected to said left and right frame members and extending downwardly therefrom to limit the movement of said left and right frame members about said axle when a downward force is exerted on said rectangular frame.

5. An improved bed frame as described in claim 2 further comprising an inclined platform connected to said rectangular frame for supporting a mattress and box spring ensemble and having an upper planar support surface sloping downwardly from said first end member toward said second end member.

6. An improved bed frame as described in claim 5 further comprising a retaining strip connected to said support surface and extending perpendicular to said longitudinal axis to prevent said mattress or box spring ensemble from sliding on said support surface.

7. An improved bed frame resting on a horizontal, substantially planer support surface and comprising:

(a) a rectangular frame pivotally mounted to supporting fulcrum means for pivotal movement about a horizontal rotational axis parallel to a longitudinal axis of said rectangular frame, wherein said fulcrum means includes: an axle rotatably mounted to said rectangular frame and extending parallel to the longitudinal axis thereof; and, a pair of circular hubs connected to opposite ends of said axle and a pair of inflatable envelopes, each engaged by and extending around the diameter of one hub of said pairs of hubs wherein said envelopes are pneumatically inflated to elastically support said pair of hubs;

(b) first means connected to said rectangular frame laterally of said longitudinal axis for elastically supporting said rectangular frame wherein said first supporting means includes at least one left coil spring connected at one end thereof to said rectangular frame in laterally distal relation to said rotational axis and extendinq downwardly from said rectangular frame and in contact with said support surface to limit the rotation of said rectangular frame about said axis thereby elastically supporting said rectangular frame relative to said support surface; and (c) second means connected to said rectangular frame laterally of said longitudinal axis and opposite said first elastic support means for elastically supporting said rectangular frame wherein said second supporting means includes at least one riqht coil spring connected at one end thereof to said rectangular frame in laterally distal relation to said rotational axis and extending downwardly from said rectangular frame and in contact with said support surface to limit the rotation of said rectangular frame about said axis thereby elastically supporting said rectangular frame relative to said support surface.

8. An improved bed frame as described in claim 7 wherein said fulcrum means further comprises:

(a) a first plurality of laminated leaf springs connected at each end thereof to said rectangular frame proximal opposite lateral sides thereof and adjacent to a first end thereof wherein said first plurality of laminated leaf springs extend downwardly from said rectangular frame and are tensioned in a shallow U-shape; and (b) a second plurality of laminated leaf springs connected at each end thereof to said rectangular frame proximal opposite lateral sides thereof and adjacent to a second end thereof opposite said first end, wherein said second plurality of laminated leaf springs extend downwardly from said rectangular frame and are tensioned in a shallow U-shape and wherein said axle is rotably mounted to said first and second plurality of laminated leaf springs proximal a lowermost extension thereof.

9. An improved bed frame as described in claim 8 further comprising one or more pneumatic shock absorbers connected to said rectangular frame and mounted to said first plurality of laminated leaf springs proximal to said axle.

10. An improved bed frame as described in claim 8 further comprising one or more pneumatic shock absorbers connected to said rectangular frame and mounted to said second plurality of laminated leaf springs proximal to said axle.

11. An improved bed frame as described in claim 7 further comprising a plurality of stop members connected to said rectangular frame on either lateral side of said longitudinal axis and extending downwardly from said rectangular frame to limit the downward movement thereof when a downward force is exerted thereon.

12. An improved bed frame as described in claim 7 further comprising a platform connected to said rectangular frame and sloping along said longitudinal axis thereof for supporting a mattress and box spring ensemble at an incline.

* * * * *